US005746617A

United States Patent [19]

Porter, Jr. et al.

[11] Patent Number: 5,746,617

[45] Date of Patent: May 5, 1998

[54] SELF ALIGNING COAXIAL CONNECTOR ASSEMBLY

[75] Inventors: Frank Kendall Porter, Jr., Billerica; James J. Kerrigan, Andover, both of Mass.

[73] Assignee: Quality Microwave Interconnects, Inc., Wilmington, Mass.

[21] Appl. No.: 674,882

[22] Filed: Jul. 3, 1996

[51] Int. Cl.[6] ..... H01R 13/64

[52] U.S. Cl. ..... 439/248; 439/552; 439/578

[58] Field of Search ..... 439/246–248, 439/252, 552, 553, 578

[56] References Cited

U.S. PATENT DOCUMENTS

| | | | |
|---|---|---|---|
| 3,094,364 | 6/1963 | Lingg | 439/247 |
| 4,227,765 | 10/1980 | Neumann et al. | 439/248 |
| 4,426,127 | 1/1984 | Kubota | 439/609 |

FOREIGN PATENT DOCUMENTS

| | | | |
|---|---|---|---|
| 1072159 | 2/1984 | U.S.S.R. | 439/247 |
| 1343481 | 10/1987 | U.S.S.R. | 439/247 |

*Primary Examiner*—Gary F. Paumen
*Attorney, Agent, or Firm*—Herbert L. Bello

[57] ABSTRACT

A connector is provided for electrically and coaxially coupling a cable to a male plug assembly. The connector includes a coupling collar adapted to receive the cable therein and to selectively receive the male plug assembly in mating engagement with the cable. The connector also includes a housing adapted to movably support the coupling collar such that the coupling collar is freely movable in a substantially orthogonal direction relative to the coaxial direction to facilitate the mating engagement. A spring is provided to urge the connector towards mating engagement. The coupling collar is generally cylindrical and includes a flange which extends outwardly from the periphery of the collar in the substantially orthogonal direction. The flange is slidably supported within a substantially planar centering washer such that the flange is adapted to move in the substantially orthogonal direction within the centering washer. The centering washer is concentrically and slidably disposed within an elongated bore of the stationary housing and is supported within the bore by the spring.

24 Claims, 7 Drawing Sheets

SELF ALIGNING COAXIAL CONNECTOR ASSEMBLY

BACKGROUND OF THE INVENTION

1. Field of the Invention

This invention relates to electrical connectors, more particularly, is directed towards self-aligning, pluggable connectors for electrically coupling two components in an electrical circuit assembly.

2. Description of the Prior Art

Pluggable electrical connectors have applications in many electronic environments for such uses as connecting component modules to mother boards, connecting component modules to other component modules, as well as various other electronic systems packaging configurations. Pluggable connectors permit rapid access to the individual components for maintenance or repair functions. Such connectors are particularly desirable for use in "blind connector" applications in which a plug-in type module or chassis is generally connected at a rear face thereof to a recessed, or other substantially inaccessible location in a rack system or similar component. One type of coaxial connector assembly is shown in U.S. Pat. No. 4,426,127.

Most high performance radio frequency (RF) and microwave applications employ coaxial transmission lines and thus, it is desirable to employ blind connectors adapted for connecting coaxial cable. This latter use, however, tends to be somewhat problematic. A principle requirement for such a pluggable electrical connector is to provide a convenient connection means which effects an acceptably low disturbance of the electrical signals being transmitted or carried between the coupled components. This is particularly critical in RF and microwave applications, where electrical connector assembly performance characteristics can heavily influence impedance matching and total electrical systems performance. Indeed, it is desirable to keep microwave transmission lines uninterrupted from source to destination. In practice, however, the practical manufacturing, distribution and placement of microwave components typically prevents the achievement of continuous microwave transmission lines. Breaks in these lines are however kept to a minimum and any such breaks are made as transparent to the transmitted signal as possible by efficient electromechanical connections.

There is therefore a need for a connector or connector system capable of coupling segments of coaxial cabling with minimal detriment to electrical efficiency for use as blind connectors in high performance RF and microwave applications.

Coaxial cabling typically consists of a central conductor material surrounded by an outer conductor material. While the central conductor material generally is a wire, the outer conductor typically is formed by braiding fine metallic threads. The central and outer conductors are separated by a non-conductive, dielectric material. An outer jacketing material can be employed to protectively encase the outer conductor material. To achieve maximum electrical efficiency, the cable segments must be axially and angularly aligned to high precision, as well as placed in mutual contact. The alignment and spacing requirements are exceedingly demanding due to the minute size of the inner conductor material.

Numerous systems have been developed to achieve the desired alignment of the conducting materials. In one commonly used RF connector, initial coaxial alignment of mating male and female connectors is accomplished through the mating of male and female threaded interfaces. This performs a first order mechanical engagement and rough alignment. As the female connector is threaded onto the male connector, a second order electromechanical engagement is realized internal to the assembly. This second order effect completes the RF transmission line and provides for relatively efficient electrical connection.

This common RF connector is sufficient for many applications such as those involving relatively few connections where individual coaxial cables connect directly to chassis mounted bulkhead or plug interfaces and in which convenient access to the connector interfaces is available. In such applications, mechanical alignment compliance and tolerances associated with each independent connector interface are non-issues and adequate operation is nominally assured.

The situation becomes more complex in configurations in which a chassis having a series of male bulkhead or plug assemblies must engage and mate a series of fixed rack mounted connectors. Even if the difficulty and inconvenience of threadably connecting multiple sets of male and female connector interfaces were overcome, the coaxial requirements of the remaining second order component interfaces would require prohibitively close tolerances of the chassis, rack and each of the mating mechanical interfaces thereon. Moreover, this problem is exacerbated in typical rack and chassis type applications, in which, as discussed above, the connectors are used in "blind mating" configurations where access to the connector interface is restricted. In these and other similar installations the commercially available RF connectors tend to be specially designed for these purposes and exist in matched sets. One such connector assembly suffers from the disadvantage that the male and female connectors are moved laterally into longitudinal alignment while the male and female connectors are being urged together in a longitudinal direction. Some of these designs have difficulty operating reliably over their intended frequency bands due to mechanical features thought essential for alignment and engagement purposes. These features also tend to make them relatively expensive.

Additional expense is often incurred during bench and field testing of the chassis module since both procedures typically utilize low cost traditional RF connectors in which manual engagement with threaded couplings is employed.

It is therefore desirable to provide a relatively inexpensive connector for use in rack mounted devices, which has reduced sensitivity to precise manufacturing tolerances to accomplish blind mating at relatively low cost, without compromise to RF performance.

SUMMARY OF THE INVENTION

In accordance with the above, it is an object of the present invention to provide a pluggable coaxial connector which accomplishes mechanical blind mating at relatively low cost, without compromise to RF performance.

It is another object of the present invention to provide a relatively simple pluggable quick disconnect for blind mating applications which may be fabricated relatively inexpensively.

It is a further object of the present invention to provide a self-aligning pluggable coaxial connector.

It is yet a further object of the present invention to provide a self-aligning pluggable coaxial connector assembly which allows freedom of movement in a substantially orthogonal direction for alignment purposes prior to full contact of the male and female connectors.

According to an embodiment of this invention, a female connector assembly is provided for coupling with a cable to a male plug assembly. The connector includes a coupling collar adapted to receive the male plug assembly in mating engagement therewith. The connector also includes a housing adapted to movably support the coupling collar such that the coupling collar is movable in a substantially orthogonal direction relative to the coaxial direction to facilitate the mating engagement. An urging member is provided to urge and hold the female connector and male plug in tight mating engagement.

Advantageously, the movability of the collar in the orthogonal direction serves to compensate for misalignment of the connector relative to the male plug assembly for precise mating engagement of the male plug and female connector embodying the invention.

The above and other objects, features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 2:
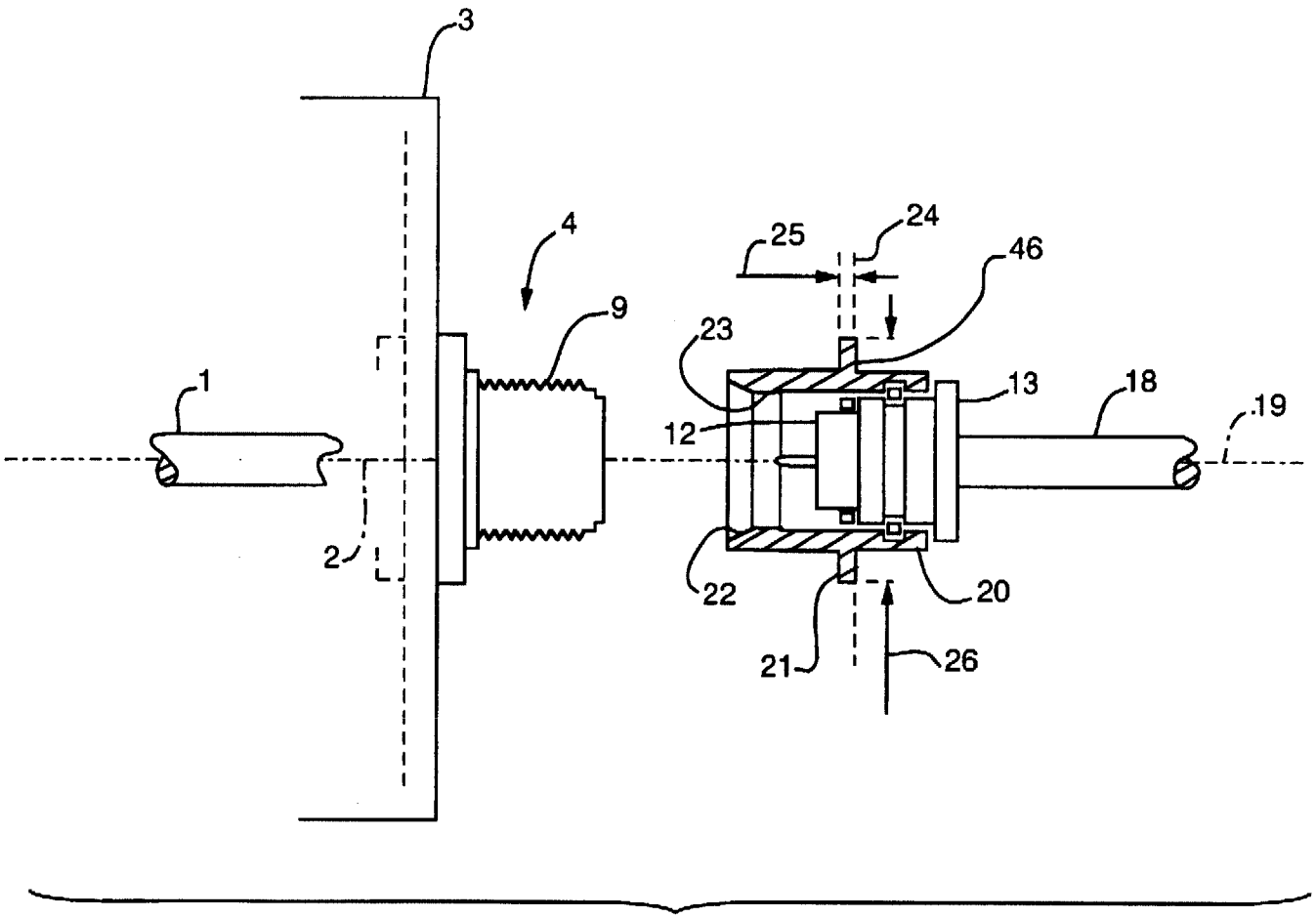
FIG. 2 is a partially cross-sectioned, exploded elevational side view of portions of a connector assembly embodying the present invention.
Figure 3:
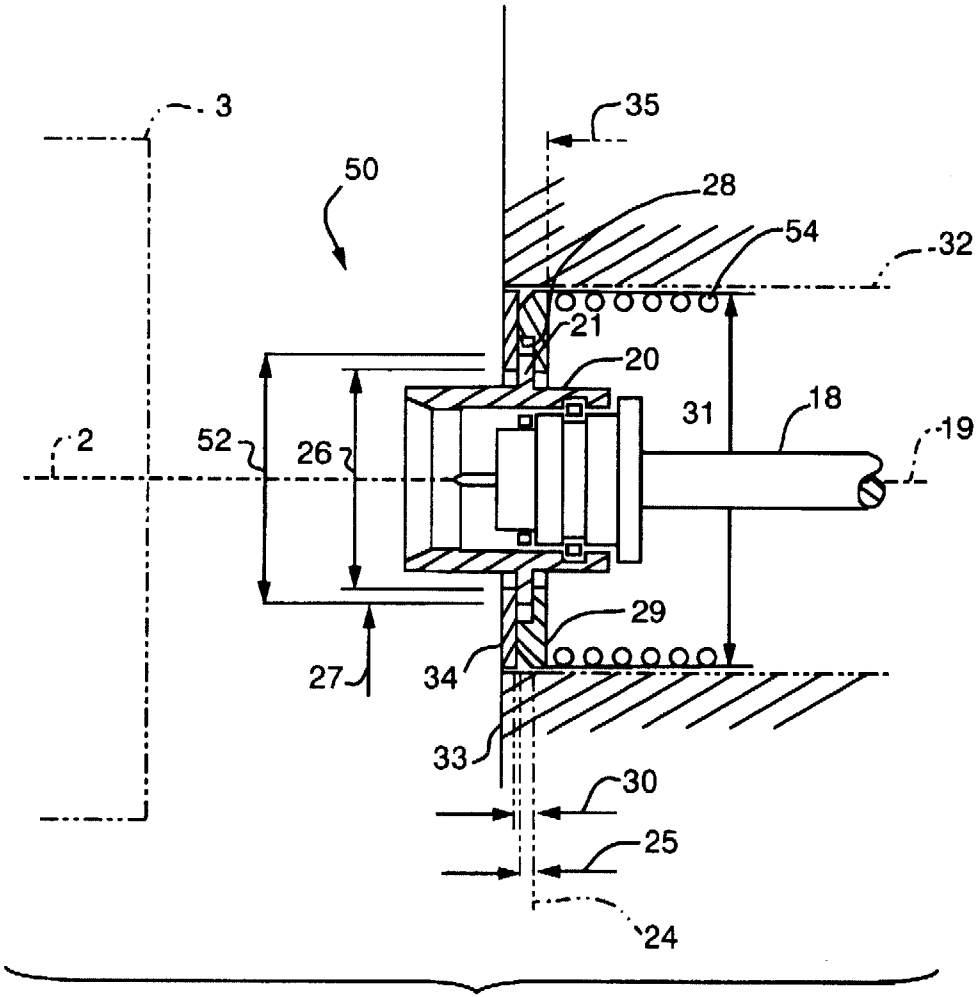
FIG. 3 is an enlarged cross-sectional elevational side view of a connector of the present invention.

Referring now to the drawings, particularly FIGS. 2 and 3, the present invention comprises a connector 50 (FIG. 3) for electrically coupling a coaxial cable 18 (FIG. 2) to a complementary connector assembly or male plug assembly 4 (FIG. 2). Connector 50 includes a coupling member or coupling collar 20 which is disposed within, and slidable relative to, a stationary housing 33 (FIG. 3) to enable coupling collar 20 to move in a substantially unrestricted fashion in a direction generally orthogonal or transverse to its central axis or theoretical centerline 19. This freedom of movement enables the connector 50 to self adjust during engagement with male plug assembly 4 to compensate for any misalignment therewith. In this manner, any such misalignment is compensated nominally without introduction of orthogonal stress or strain to the mating componentry. This serves to reduce failures due to connector breakage and to promote enhanced electrical contact between connector 50 and male plug assembly 4 for improved connector performance.

For definitional purposes, throughout this disclosure the terms "longitudinal", "axial" and "coaxial" shall refer to directions substantially parallel to a theoretical centerline or axis 2 of male plug assembly 4 or to axis 19 of connector 50. "Orthogonal", "transverse" and "radial" shall be defined as directions substantially perpendicular to the above described longitudinal, axial and coaxial directions.

Figure 1:
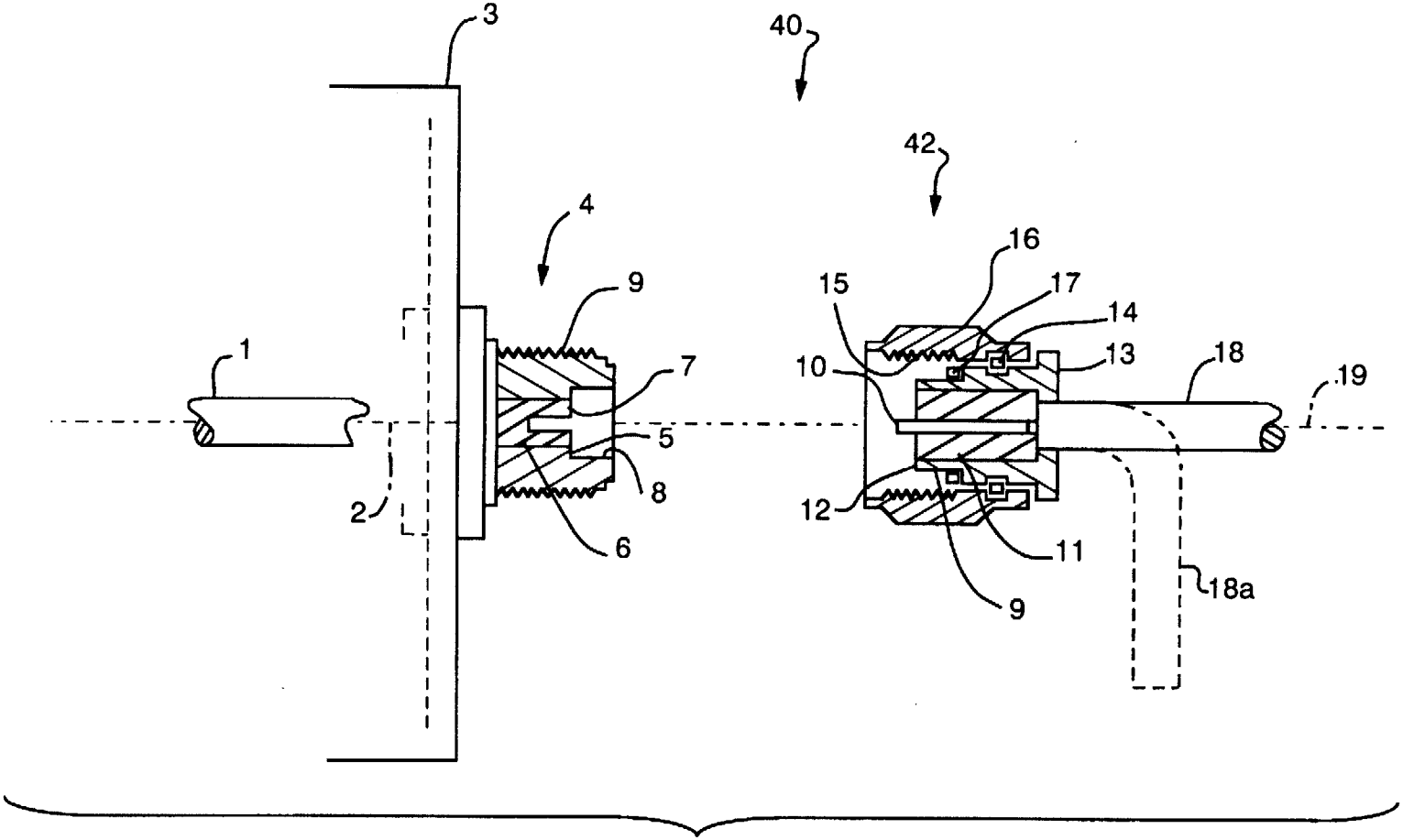
FIG. 1 (PRIOR ART)
FIG. 1 is a partially broken away, partially cross-sectioned, exploded elevational side view, with portions shown in phantom, of a coaxial connector assembly of the prior art.

Referring to FIG. 1, a conventional threaded RF connector 40 includes male connector or male plug assembly 4 and mating connector or female connector 42. As shown, a transmission line 1 extends within a chassis 3 into, and is engaged by, male connector 4. The male connector has a theoretical centerline or axis 2 which is coaxial with the portion of the transmission line engaged by the male connector. Male connector 4 is fabricated from an electrically conductive material such as a suitable metallic alloy and typically includes conventional signal transferal features, such as a metal contact socket 7, insulator 6 and metal contact face 5. Additional features of the male connector include an external thread 9 and internal bore 8, both of which are substantially coaxial with theoretical centerline 2.

Conventional mating connector 42 includes a shell 13, with metallic center pin 10, contact face 12, transitional diameter 9, and insulator 11. Coupling nut 16, with internal thread 15 is fastened by retaining ring 14 to shell 13 to allow free rotation of coupling nut 16 about an axis nominally coaxial to both shell 13 and theoretical centerline or axis 19. Depending upon requirements, a seal ring 17, which operates in a manner familiar to one skilled in the art, may be included in the assembly but does not affect electrical performance directly. Transmission line 18 is engaged by shell 13 in any of various methods of attachment known to one skilled in the art. The portion of the transmission line which is so engaged is coaxial with theoretical centerline 19. As shown in phantom, transmission line **18*a* is a right angle variation of transmission line 18** which may, in general, afford a more compact implementation for some typical applications.

Conventional engagement of this connection is accomplished manually by first rough alignment of internal thread 15 of coupling nut 16 with external thread 9 of male connector 4. This causes approximate coaxial alignment of theoretical centerlines 2, and 19. As coupling nut 16 is rotated further, transitional diameter 9 of shell 13 engages internal bore 8 of male connector 4 and theoretical centerlines 2 and 19 continue to become more closely coaxially aligned. As the coupling nut 16 is rotated still further, center pin 10 engages contact socket 7 and the first measurable mechanical resistance is realized. As the coupling nut 16 is further rotated, a point is reached where contact face 5 of male connector 4 engages contact face 12 of shell 13, preventing further movement. The coupling nut 16 is then typically torqued to some predetermined level to prevent loosening. This configuration thus serves to nominally coaxially align theoretical centerlines 2 and 19, while providing a preload or engagement force which maintains contact face 5 of male connector 4 in engaged contact with contact face 12 of shell 13 for optimal electrical performance.

For explanatory purposes, features of the assembly embodying the present invention which are substantially similar to the prior art connector assembly of FIG. 1 will be identified with identical reference numerals throughout this disclosure. Although a threaded RF connector is shown, it is to be understood that the invention is suitable for bayonette or unthreaded connectors.

Referring now to FIG. 2, the present invention includes a coupling collar 20, in lieu of coupling nut 16 of the prior art. Coupling collar 20 includes a smooth cylindrical bore 23, having a lead frusto-conical section or cam surface 22 and radial flange 21 of predetermined thickness 25, which will be discussed in greater detail hereinafter. Radial flange 21 also includes an engagement surface 46 which defines an orthogonal plane 24. Remaining features shown are substantially similar to those described hereinabove with respect to FIG. 1. If centerlines 2 and 19 are maintained in substantially coaxial orientation and sufficient longitudinal or axial force is applied to surface 46 of radial flange 21, suitable mechanical contact will occur at contact face 5 (FIG. 1) of male connector 4 and contact face 12 of shell 13 to provide satisfactory electrical performance, as will be discussed in greater detail hereinafter.

As shown in FIG. 3, coupling collar 20 is incorporated into connector 50 of the present invention. Connector 50 further includes a substantially planar centering washer 29, for example, a centering ring, ring 29 having a recessed bore 28 of predetermined diameter 52, depth 30 and which terminates at terminal surface 48. Centering ring 29 is oriented so that plane 24 represents the coplanar position of surface 46 of radial flange 21 and engagement surface 48 of centering ring 29. Centering ring 29 is provided with an outer diameter 31 of predetermined size so as to slidably and concentrically fit within a bore 32 of a stationary housing 33. A retaining washer 34 is rigidly captured by any suitable means (not shown) in stationary housing 33 to retain centering ring 29 and coupling collar 21 within bore 32. A longitudinal or axial spring force 35, applied by appropriate means such as a coil compression spring 54 (FIG. 8), urges centering ring 29 towards an initial longitudinal position in engagement with retaining washer 34 as shown. In this manner, coupling collar 20 is resiliently supported within stationary housing 33, such that collar 20 is provided with freedom of movement in the axial direction relative to stationary housing 33 against the bias of axial spring force 35.

In addition, radial flange 21 of coupling collar 20 is provided with a predetermined thickness 25 and diameter 26, and bore 28 is provided with a predetermined depth 30 and diameter 52, to provide sufficient axial clearance for flange 21 to slide freely in the orthogonal directions between centering ring 29 and washer 34 when the centering ring is disposed in its initial longitudinal position as shown. Diameters 26 and 52 are dimensioned so as to permit the collar 20 to move a predetermined clearance distance 27 in any orthogonal direction from the concentric positions of centering ring 29 and collar 20 as shown. This construction thereby serves to effectively confine coupling collar 20 within bore 28, while enabling coupling collar 20 freedom of substantially unrestricted orthogonal movement relative to centering ring 29, within a predetermined range of movement defined by the difference between diameters 26 and 52.

Indeed, virtually the only force restricting this orthogonal movement is a negligible frictional force generated by flange 21 sliding relative to centering ring 29 and/or retaining washer 34. In this regard, the frictional force is minimized by fabrication of flange 21 and centering ring 29 and retaining washer 34 from suitable material having substantially smooth contact surfaces and relatively low coefficients of friction, for example, a metal or a high impact polymer. A frictional force F generated on a surface is generally equal to the coefficient of friction $\mu$ times the magnitude of a force N applied normal to the surface, i.e. $F=\mu N$. Since both the coefficient of friction, as well as the relatively minimal force applied normal to the surface by spring force 35 (as will be discussed hereinafter), are relatively small, frictional force F tending to resist the orthogonal movement will be similarly small. Moreover, when centering ring 29 is in its initial longitudinal position as shown, the aforementioned axial tolerances serve to prevent axial spring force 35 from bearing on flange 21. Spring force 35 instead bears against retaining washer 34 through centering ring 29. Accordingly, when centering ring 29 is in its initial position, applied force N generated by spring force 35 is negligible, so that frictional force F generated by spring force 35 during the initial alignment steps of mating engagement, as will be discussed in greater detail hereinafter, is also negligible. The present invention therefore permits substantially unrestricted orthogonal movement to compensate misalignments nominally without application of orthogonal stress or potential energy to components of connectors 4 and 50 as a result of the mating engagement. Theoretical centerline 19 of collar 20 is thereby conveniently permitted to assume an essentially parallel, but non-coaxial, position relative to bore 32 of stationary housing 33, as will be discussed in greater detail hereinafter with respect to FIG. 5.

Figure 7:
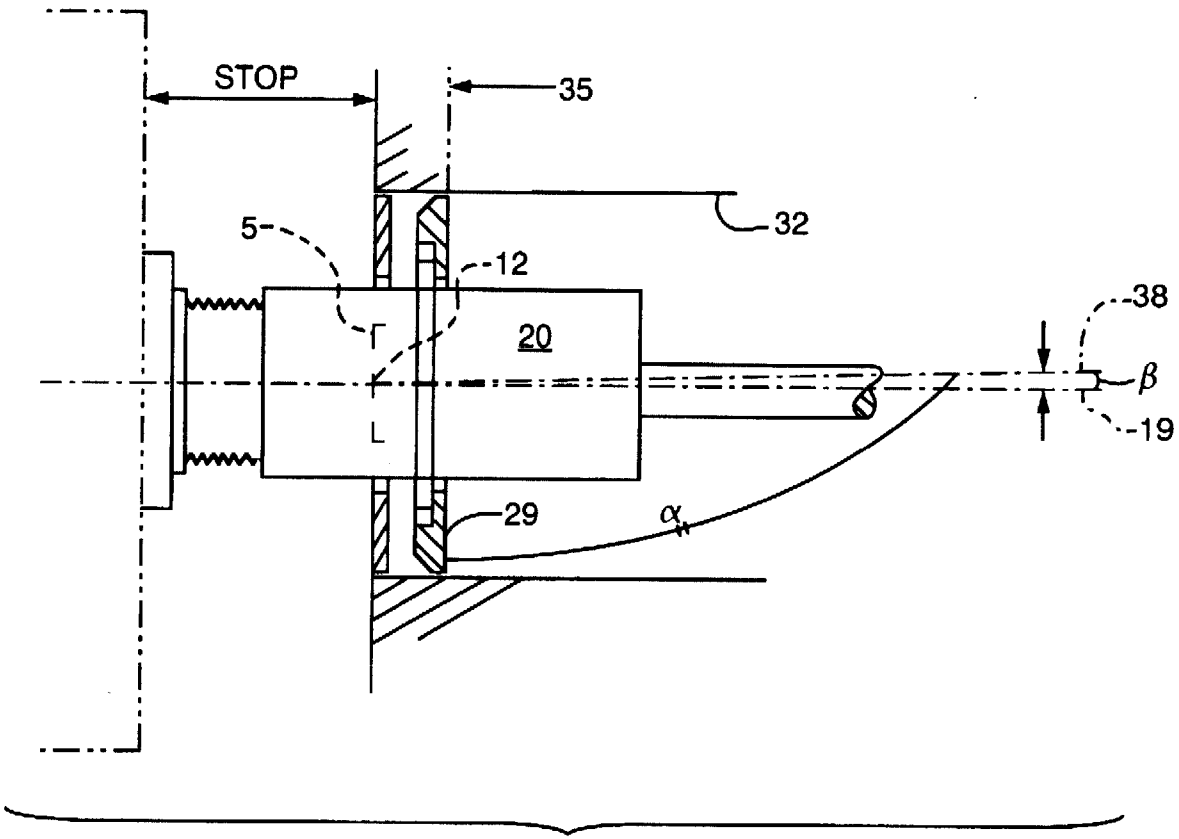
FIG. 7 is an enlarged, elevational side view of a connector assembly embodying the present invention, with portions thereof shown in phantom, during the step in the operation thereof of FIG. 6.

In addition, collar 20 and centering ring 29 are permitted to tilt or cant against the bias of spring force 35 to a position in which theoretical centerline 19 is disposed at an oblique angle with respect to an actual centerline 38 of bore 32 as shown in FIG. 7 and as will be discussed hereinafter. Accordingly, the present invention thus effectively provides coupling collar 20 with freedom of movement in substantially any direction for movement as a "free body" relative to stationary housing 33, to facilitate mating engagement while nominally eliminating application of stress or potential energy on connector components in the orthogonal direction. This will become more apparent with respect to the operation of the present invention discussed hereinafter.

Figure 4:
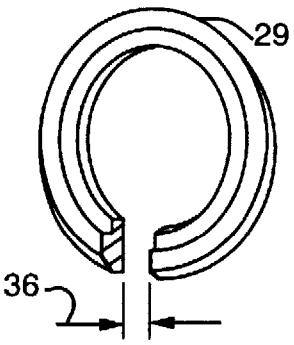
FIG. 4 is a perspective view of a portion of the connector of FIG. 3.

Referring now to FIG. 4, a preferred embodiment of centering ring 29 is provided with a slot 36 to facilitate assembly relative to transmission line 18 in a manner which will be familiar to one skilled in the art.

A preferred embodiment of the invention having been fully described, the following is a description of the operation thereof.

Figure 5:
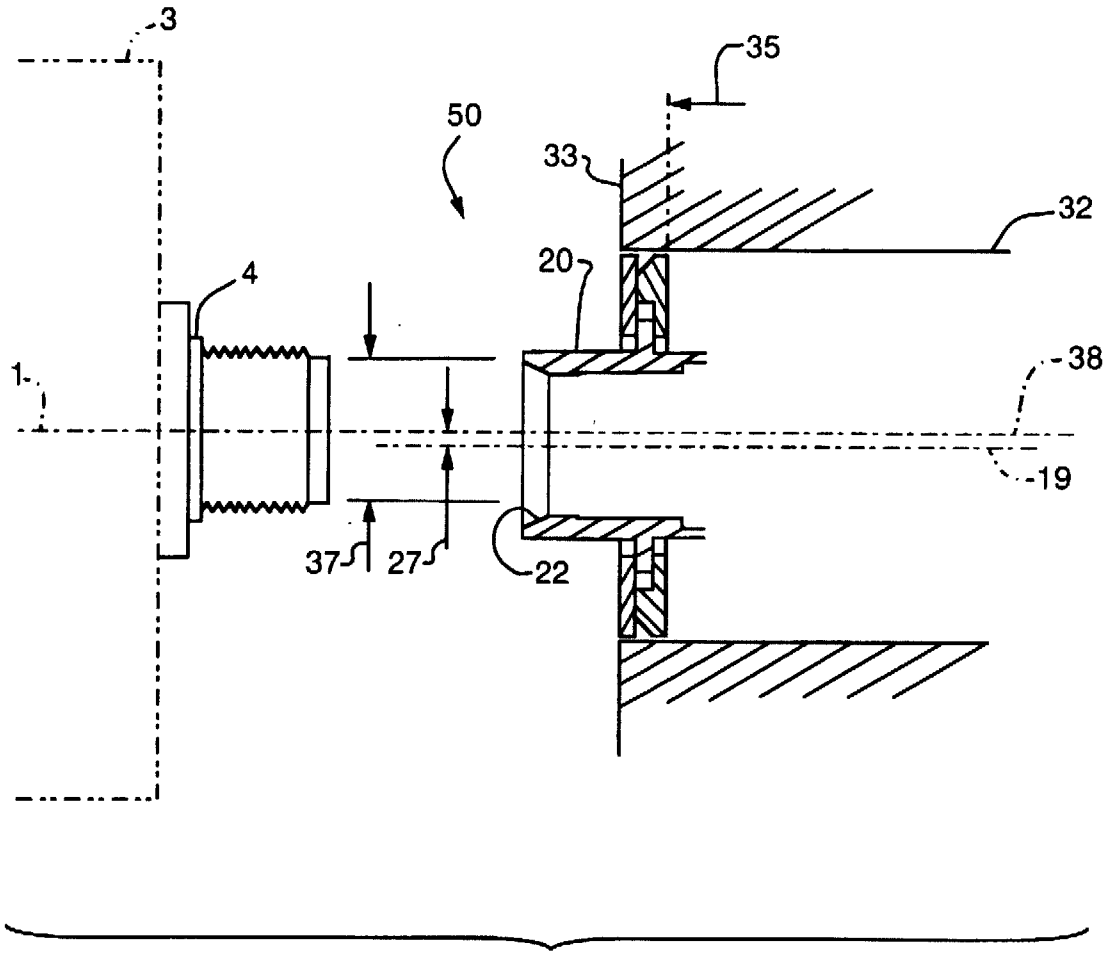
FIG. 5 is a partially cross-sectional, exploded elevational side view of portions of a connector assembly embodying the present invention, during a step in the operation thereof.
Figure 8:
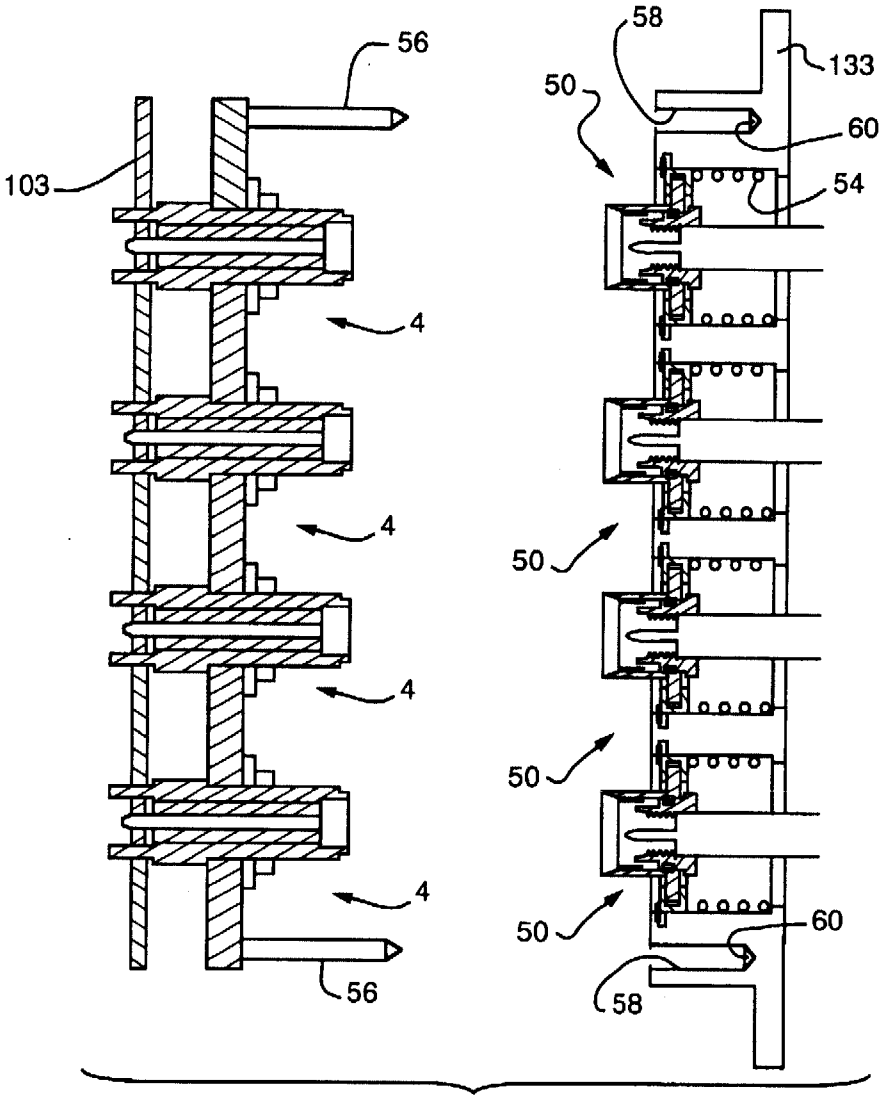
FIG. 8 is a reduced scale, elevational side view of a connector assembly embodying an alternate embodiment of the present invention.

Referring now to FIG. 5, in a first step in the operation of the present invention, chassis 3 and concomitantly, plug assembly 4, is oriented so that theoretical centerline 1 is generally axially aligned with actual centerline 38 of stationary housing 33. This general alignment may be provided by any common alignment means, such as conventional guide pins 56 (FIG. 8) engaged with mating bores 58 (FIG. 8). Assuming misalignment between male connector 4 and connector 50, such as may occur due to typical manufacturing tolerances, continued movement of connector 50 into initial mating engagement with plug assembly 4 serves to engage lead frusto-conical section or cam surface 22 with external diameter 36 of male connector 4. This engagement serves to initiate camming action or self acting deflection of the coupling collar 20 to move collar 20 (and its theoretical centerline 1) into coaxial alignment with external diameter 36 (and theoretical centerline 19). During this mating movement, spring force 35 generally maintains coupling collar 20 in its initial longitudinal position relative to bore 32 and, as discussed hereinabove, offers no impediment to the radial translation and alignment of the collar with plug assembly 4. Accordingly, as discussed hereinabove, the radial translation or orthogonal movement takes place nominally without generating any orthogonal stress or potential energy, or otherwise deforming or preloading any of the componentry of male connector 4 or connector 50. This feature advantageously provides for improved performance and reduced wear relative to prior constructions.

Figure 6:
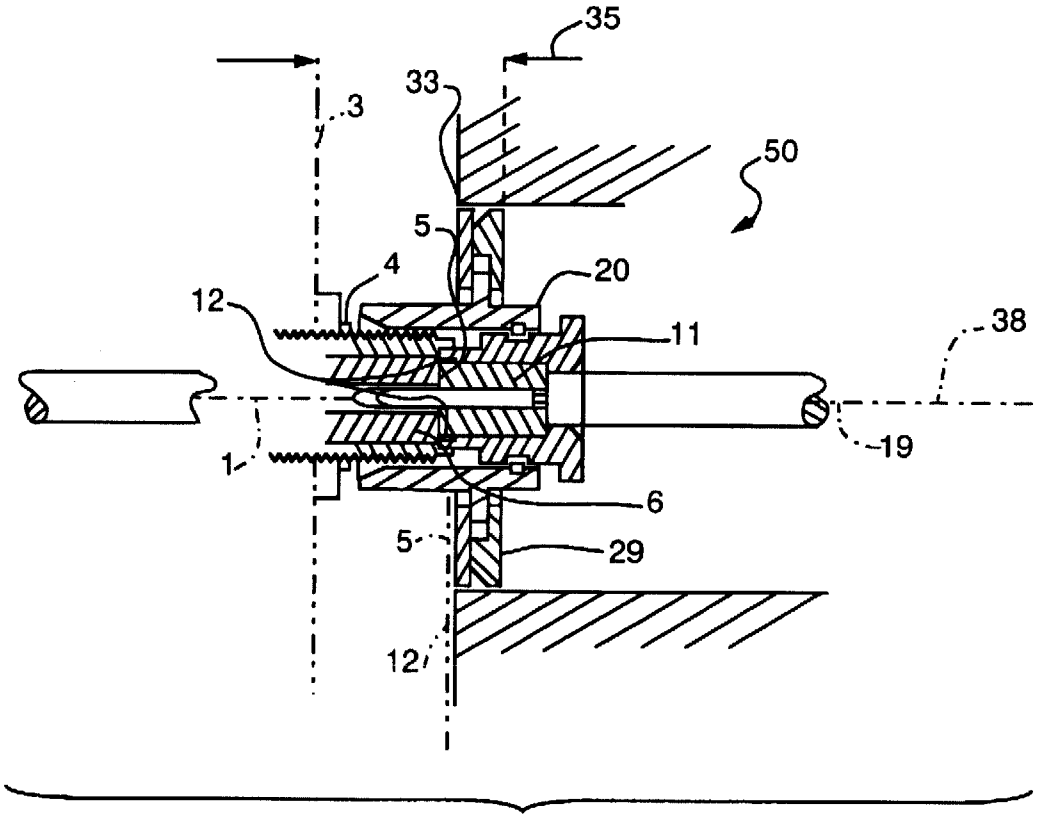
FIG. 6 is an enlarged, cross-sectional, elevational side view of the connector assembly of FIG. 5 during a further step in the operation thereof.

As shown in FIG. 6, continued mating movement of plug assembly 4 towards connector 50 will bring contact face 5 of male connector 4 into coplanar engagement with contact face 12 of connector 50. At this step in the operation of the present invention, theoretical center lines 1 and 19 are disposed in nominally coaxial alignment for optimum transmission line continuity. As discussed hereinabove, in the prior art, axial force necessary to electrically unify contact faces 5 and 12 is commonly produced with coupling nut 16 (FIG. 1) as a result of torque applied to prevent mechanical loosening of the connector assembly in service. In typical pluggable or chassis/rack applications for which the present invention can be applied, mechanical loosening is not possible due to external means (not shown) commonly used for maintaining chassis 3 in engagement with stationary housing 33. Accordingly, as mentioned hereinabove, the present invention requires only a relatively minimal axial force, namely, one that is sufficient merely to maintain electrical unification of faces 5 and 12. In this regard, continued mating movement of chassis 3 toward stationary housing 33 serves to deflect coupling collar and centering ring 29 relative to bore 32 (see FIG. 7) against the bias of spring force 35, to thereby bring spring force 35 to bear directly upon contact faces 5 and 12 to help ensure that connectors 4 and 50 are electrically unified. This deflection also serves to advantageously compensate for longitudinal tolerances in connectors 4 and 50. Connectors 4 and 50 thus reach a fully mated position after occurance of such deflection. This fully mated position may be indicated by conventional means such as engagement of guide pins 56 within mating bores 58 having stops 60 as shown in FIG. 8.

Referring now to FIG. 7, the fully mated position of the cable assembly embodying connector 50 of the present invention may be achieved in spite of inherent non-parallel alignment of actual centerline 38 of bore 32 and theoretical centerline 19. As shown, the freedom of movement accorded coupling collar 20 by the construction of the present invention permits contact faces 5 and 12 to fully engage one another in full surface to surface contact, regardless of the inherent non-parallel orientation of center lines 2 and 19 as a result of, for example, manufacturing tolerances. Indeed, as shown, the above described "free body" construction enables the substantially planar centering ring 29 to move against the bias of spring 54 (FIG. 8) to an oblique angle $\alpha$ relative to actual centerline 38 of bore 32. This effectively moves theoretical centerline 19 of coupling collar 20 askew of longitudinal axis 38 by an oblique angle $\beta$ to permit full surface to surface engagement of faces 5 and 12. This engagement serves to optimize the electrical unification of this interface and provide for optimum RF performance.

Referring now to FIG. 8, an alternate embodiment of the present invention includes the use of a plurality of connectors 50 disposed on a stationary housing 133 to matingly engage corresponding plug assemblies 4 disposed on a chassis 103. Guide pins 56 and corresponding mating bores 58 and stops 60 may preferably be employed as described hereinabove.

Thus, the subject invention presents a means of accomplishing mechanical blind mating at relatively low cost, without compromise to RF performance by employing a relatively simple construction using many traditional RF components and eliminating the need for relatively high manufacturing tolerances. Further, this invention presents a means of connection in which freedom of movement in an orthogonal direction is provided to compensate for any misalignment while nominally preventing the generation of any orthogonal preload or stress within the connector componentry. Further still, the subject invention presents a means of connection in which typical right angle devices may be utilized.

Although the subject invention has been described with respect to free body movement of a female connector, it should be recognized by one skilled in the art that a male connector may be provided with the aforementioned free body movement without departing from the spirit and scope of the invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A connector for coaxially coupling a cable to a complementary connector assembly, said connector comprising:

a) a coupling member adapted to receive the cable and to selectively matingly engage the complementary connector assembly to electrically couple the cable in coaxial alignment with the complementary connector assembly, said coupling member including a planar centering washer and a flange means, said flange means extending outwardly about a periphery of said coupling member in a substantially orthogonal direction, said flange received in said centering washer and constrained for sliding movement in a substantially orthogonal direction therein;

b) a housing adapted to movably support said coupling member wherein said coupling member is adapted for substantially unrestricted movement within a predetermined range of movement in a substantially orthogonal direction into coaxial alignment with the complementary connector assembly during initial contact of said connector and the complementary connector assembly as said connector and the complementary connector assembly are moved towards one another to facilitate the mating engagement of said connector and the complementary connector assembly; and c) an urging member adapted to resiliently urge said coaxially aligned coupling member towards said mating engagement for biased engagement of said connector and the complementary connector assembly.

2. The connector as set forth in claim 1, wherein said urging member selectively urges said coupling member towards said mating engagement.

3. The connector as set forth in claim 2, wherein said coupling member is adapted for movement relative to said housing in a direction substantially parallel to a coaxial alignment direction, between an initial position and a final position in which said coupling member is fully engaged with the complementary connector assembly, said urging member urging said coupling member towards said mating engagement upon movement of said coupling member from said initial position.

4. The connector as set forth in claim 1, wherein said urging member urges said coupling member in the coaxial alignment direction.

5. The connector as set forth in claim 1, wherein said coupling member comprises a coupling collar adapted to selectively receive a male plug assembly to electrically couple the cable in coaxial alignment with the male plug assembly.

6. The connector as set forth in claim 5, wherein said connector further comprises a bore that is sized and shaped to cooperatively receive the male plug assembly, a cam surface extending divergently from a leading edge of said bore, said cam surface being adapted to cam said connector in said substantially orthogonal direction during engaging movement of said connector relative to the male plug assembly.

7. The connector as set forth in claim 1, further comprising a plurality of said coupling members slidably supported by said housing, said plurality of said coupling members being adapted to receive a plurality of complementary connector assemblies.

8. The connector as set forth in claim 1, wherein said urging member is disposed between said housing and said coupling member to urge said coupling member, relative to said housing, towards said mating engagement.

9. The connector as set forth in claim 8, wherein said urging member is adapted to urge said coupling member in the coaxially aligned direction.

10. The connector as set forth in claim 1, wherein said coupling member is movable against the bias of said urging member to facilitate said selective mating engagement with the complementary connector assembly.

11. The connector as set forth in claim 10, wherein said coupling member is disposed within an elongated bore in said housing and said coupling member is adapted for angular movement relative to said bore and wherein a longitudinal axis of said coupling member is movable to an oblique angle relative to a longitudinal axis of said bore, said angular movement being resisted by the bias of said urging member.

12. The connector as set forth in claim 1, wherein said urging member is adapted to releasably maintain said coupling member in electrical engagement with the complementary connector assembly.

13. A connector for coaxially coupling a cable to a complementary connector assembly, said connector comprising:

a) a coupling member adapted to receive the cable and to selectively matingly engage the complementary connector assembly to electrically couple the cable in coaxial alignment with the complementary connector assembly, said coupling member including a flange extending outwardly about a periphery of said coupling member in a substantially orthogonal direction, a substantially planar centering washer, said flange being slidably supported within said substantially planar centering washer, said flange being adapted to slide in a substantially orthogonal direction within said substantially planar centering washer;

b) a housing adapted to movably support said coupling member wherein said coupling member is adapted for substantially unrestricted movement within a predetermined range of movement in a substantially orthogonal direction into coaxial alignment with the complementary connector assembly during initial contact of said connector and the complementary connector assembly as said connector and the complementary connector assembly are moved towards one another to facilitate the mating engagement of said connector and the complementary connector assembly; and c) an urging member adapted to resiliently urge said coaxially aligned coupling member towards said mating engagement for biased engagement of said connector and the complementary connector assembly.

14. The connector as set forth in claim 13, wherein said urging member urges said substantially planar centering washer towards said mating engagement.

15. The connector as set forth in claim 13, wherein said centering washer is concentrically disposed within an elongated bore of said housing, said elongated bore having a transverse geometry that is sized and shaped to slidingly engage the periphery of said centering washer.

16. The connector as set forth in claim 15, wherein said centering washer is supported within said bore by said urging member.

17. The connector as set forth in claim 16, wherein said substantially planar centering washer is adapted for movement within said bore to an oblique angle relative to a longitudinal axis of said bore.

18. A connector for coupling a cable to a complementary connector assembly, said connector comprising:

a) a coupling member adapted to receive the cable and to selectively matingly engage the complementary connector assembly to electrically couple the cable in coaxial alignment with the complementary connector assembly said coupling member including a planar centering washer and a flange means, said flange means extending outwardly about a periphery of said coupling member in a substantially orthogonal direction, said flange received in said centering washer for slidable movement in a substantially orthogonal direction therein;

b) a housing adapted to movably support said coupling member wherein said coupling member is adapted for movement in substantially any direction relative to said housing into coaxial alignment with the complementary connector assembly during initial contact of said connector and the complementary connector assembly as said connector and the complementary connector assembly are moved towards one another to facilitate the mating engagement of said connector and the complementary connector assembly; and c) an urging member adapted to resiliently resist movement of said coupling member into an oblique orientation relative to a coaxial direction and to resiliently resist movement of said coupling collar in a direction parallel to the coaxial direction, while facilitating substantially unrestricted movement in a direction substantially orthogonal to the coaxial direction.

19. A connector for coupling a cable to a male plug assembly, said connector comprising:

a) a coupling collar adapted to receive the cable and receive the male plug assembly in mating engagement with said coupling collar to electrically couple the cable with the male plug assembly, said coupling collar including a planar centering washer and a flange means, said flange means extending outwardly about a periphery of said coupling member in a substantially orthogonal direction, said flange received in said centering washer for slidable movement in a substantially orthogonal direction therein;

b) a housing adapted to retain and support said coupling collar, wherein said coupling collar is adapted for movement in substantially any direction relative to said housing into coaxial alignment with the male plug assembly during initial contact of said connector and the the male plug assembly as said connector and the male plug assembly are moved towards one another to facilitate the mating engagement of said connector and the male plug assembly; and c) an urging member adapted to resiliently resist movement of said coupling collar into an oblique orientation relative to the coaxial direction and to resiliently resist movement of said coupling collar in a direction substantially parallel to the coaxial direction, while facilitating substantially unrestricted movement in a direction substantially orthogonal to the coaxial direction.

20. A connector for coaxially coupling a cable to a complementary connector assembly, said connector comprising:

a) a coupling member adapted to receive the cable and to selectively matingly engage the complementary connector assembly to electrically couple the cable in coaxial alignment with the complementary connector assembly, said coupling member having a flange extending outwardly about a periphery of said coupling member in a substantially orthogonal direction, said flange being slidably supported within a substantially planar centering washer, said flange being adapted to slide in said substantially orthogonal direction within said substantially planar centering washer;

b) a housing adapted to movably support said coupling member wherein said coupling member is adapted for substantially unrestricted movement within a predetermined range of movement in a substantially orthogonal direction relative to a coaxial direction to facilitate the mating engagement; and c) an urging member adapted to resiliently urge said coupling member towards said mating engagement.

21. The connector as set forth in claim 20, wherein said urging member urges said substantially planar centering washer towards said mating engagement.

22. The connector as set forth in claim 21, wherein said centering washer is concentrically disposed within an elongated bore of said stationary housing, said elongated bore having a transverse geometry that is sized and shaped to slidingly engage the periphery of said centering washer.

23. The connector as set forth in claim 22, wherein said centering washer is supported within said bore by said urging member.

24. The connector as set forth in claim 23, wherein said substantially planar centering washer is adapted for movement within said bore to an oblique angle relative to a longitudinal axis of said bore.

* * * * *